United States Patent [19]

Seshamani et al.

[11] Patent Number: 4,665,864

[45] Date of Patent: May 19, 1987

[54] STEAM GENERATOR AND METHOD OF OPERATING A STEAM GENERATOR UTILIZING SEPARATE FLUID AND COMBINED GAS FLOW CIRCUITS

[75] Inventors: Venkatram Seshamani, Gillette; Walter R. Campbell, Union; Paul E. Moore, Parsipanny, all of N.J.

[73] Assignee: Foster Wheeler Energy Corporation, Livingston, N.J.

[21] Appl. No.: 885,126

[22] Filed: Jul. 14, 1986

[51] Int. Cl.[4] ..... F22B 1/00

[52] U.S. Cl. ..... 122/4 D; 122/406 R; 122/406 ST

[58] Field of Search ..... 122/4 D, 406 R, 406 S, 122/406 ST; 165/104.16

[56] References Cited

U.S. PATENT DOCUMENTS 4,457,289 7/1984 Korenberg ..... 122/4 D 4,473,032 9/1984 Maintok ..... 122/4 D 4,473,033 9/1984 Strohmeyer, Jr. ..... 122/4 D 4,614,167 9/1986 Bergkuist ..... 122/4 D

*Primary Examiner*—Edward G. Favors

*Attorney, Agent, or Firm*—Marvin A. Naigur; John E. Wilson; Warren B. Kice

[57] ABSTRACT

A steam generator and method for operating same in which a plurality of beds of combustible particulate material are established and air is introduced to each of the beds for fluidizing the beds. The flue gases and entrained fine particulate material from each bed are combined and the particulate material then separated from the flue gases externally of the beds and introduced back into one of the beds. Independent fluid circuits are established including some in heat exchange relation to the separate beds, for independently controlling the steam generation rate and the temperatures of the reheat steam, and the superheat steam.

22 Claims, 6 Drawing Figures

STEAM GENERATOR AND METHOD OF OPERATING A STEAM GENERATOR UTILIZING SEPARATE FLUID AND COMBINED GAS FLOW CIRCUITS

BACKGROUND OF THE INVENTION

This invention relates to a steam generator and a method of operating same in which heat is generated by the combustion of fuel in a plurality of fluidized beds.

Steam generating systems utilizing fluidized beds as the primary source of heat generation are well known. In these arrangements, air is passed through a bed of particulate material, including a fossil fuel such as coal and an adsorbent for the sulfur generated as a result of combustion of the coal, to fluidize the bed and to promote the combustion of the fuel at a relatively low temperature. The heat produced by the fluidized bed is utilized to convert water to steam which results in an attractive combination of high heat release, high sulfur adsorption, low nitrogen oxides emissions and fuel flexibility.

The most typical fluidized bed combustion system is commonly referred to as a bubbling fluidized bed in which a bed of particulate materials is supported by an air distribution plate, to which combustion-supporting air is introduced through a plurality of perforations in the plate, causing the material to expand and take on a suspended, or fluidized, state. In a steam generator environment, the walls enclosing the bed are formed by a plurality of heat transfer tubes, and the heat produced by combustion within the fluidized bed is transferred to water circulating through the tubes. The heat transfer tubes are usually connected to a natural water circulation circuitry, including a steam drum, for separating water from the steam thus formed which is routed to a turbine or to another steam user.

In an effort to extend the improvements in combustion efficiency, pollutant emissions control, and operation turndown afforded by the bubbling bed, a fluidized bed reactor has been developed utilizing a circulating fluidized bed process. According to this process, fluidized bed densities between 5 and 20% volume of solids are attained which is well below the 30% volume of solids typical of the bubbling fluidized bed. The formation of the low density circulating fluidized bed is due to its small particle size and to a high solids throughput, which require high solids recycle. The velocity range of a circulating fluidized bed is between the solids terminal, or free fall, velocity and a velocity beyond which the bed would be converted into a pneumatic transport line.

The high solids circulation required by the circulating fluidized bed makes it insensitive to fuel heat release patterns, thus minimizing the variation of the temperature within the steam generator, and therefore decreasing the nitrogen oxides formation. Also, the high solids loading improves the efficiency of the mechanical device used to separate the gas from the solids for solids recycle. The resulting increase in sulfur adsorbent and fuel residence times reduces the adsorbent and fuel consumption.

However the circulating fluidized bed process is not without problems, especially when used in a steam generation environment. For example, it normally lacks a method of independently controlling the outlet temperature of the reheat as compared to the temperature of the main steam and/or superheat, especially when it is necessary to heat both of these fluids to temperatures of 950° F. or higher and maintain these temperature levels over a wide control range without excessive attemperation.

SUMMARY OF THE INVENTION

It is therefore an object of the present invention to provide a steam generator and a method of operating same in which a flow circuit is provided for the reheat steam which is independent of the circuitry for the other steam stages.

It is a further object of the present invention to provide a steam generator and method of the above type in which an independently fired fluidized bed is provided to directly affect the control of the temperature of the reheat steam, and separate fluidized beds are provided for controlling the steam generation rate and the temperature of the superheat steam.

It is a still further object of the present invention to provide a steam generator and method of the above type in which a bubbling fluidized bed is associated with the steam generation and the superheat flow circuitry and a circulating fluidized bed is associated with the reheat flow circuitry.

Toward the fulfillment of these and other objects, a plurality of beds of particulate material are established and air and fuel are introduced to each of the beds for fluidizing the beds. The flue gases and entrained fine particulate material from each bed are combined and then particulate material is separated from the flue gases externally of the beds and introduced back into one of the beds. Independent fluid circuits are established, including some in a heat exchange relation to the separate beds, for independently controlling the steam generation rate and the temperature of the reheat steam and the superheat steam.

BRIEF DESCRIPTION OF THE DRAWINGS

The above brief description as well as further objects, features and advantages of the method of the present invention will be more fully appreciated by reference to the following detailed description of presently preferred but nonetheless illustrative embodiments in accordance with the present invention when taken in conjunction with the accompanying drawing in which.

DESCRIPTION OF THE PREFERRED EMBODIMENT

Figure 1:
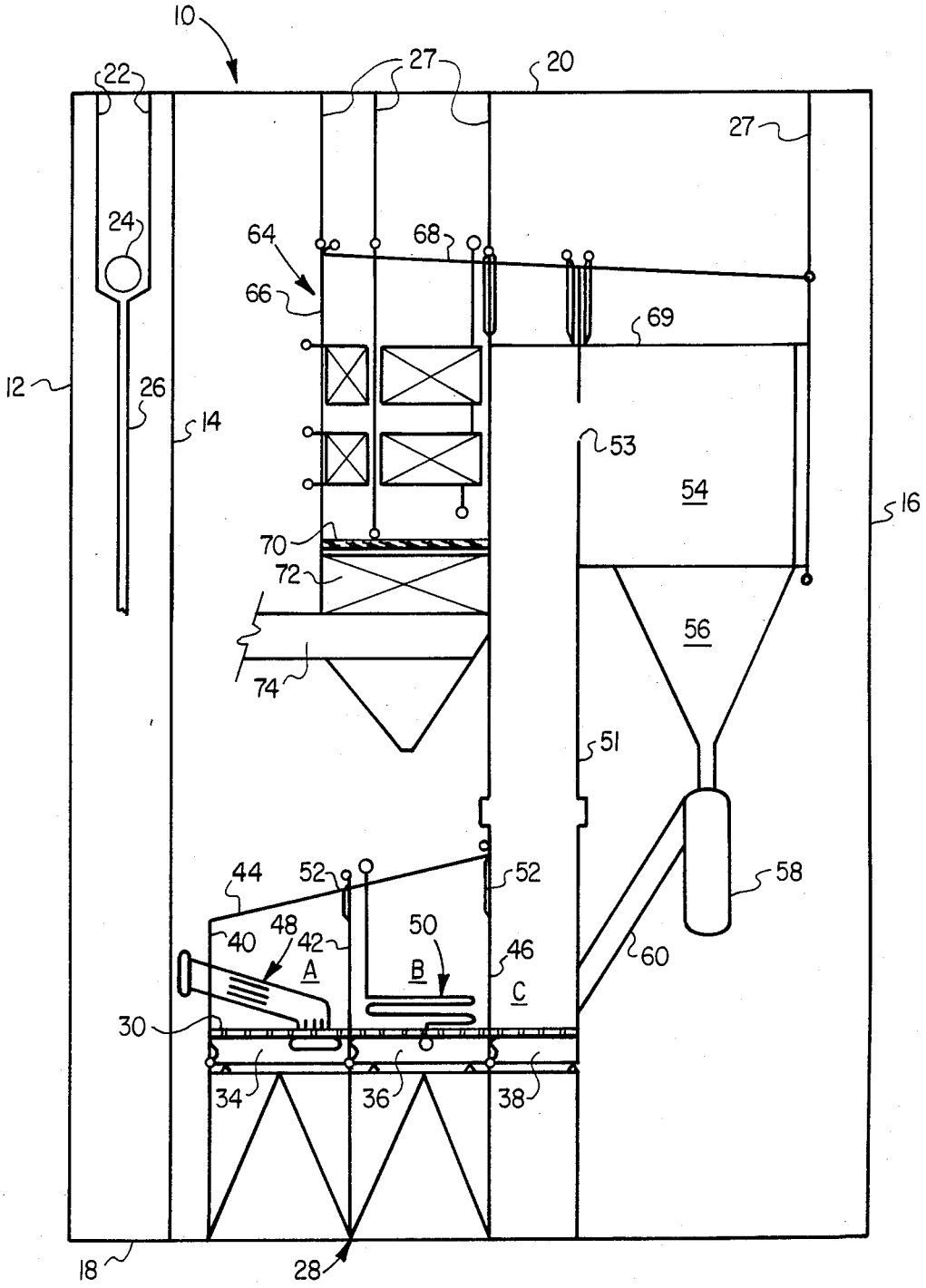
FIG. 1 is a schematic view of a forced circulation steam generator employing features of the present invention.

Referring specifically to FIG. 1 of the drawing, the reference numeral 10 depicts, in general, a forced circulation steam generator according to the present invention including a plurality of elongated vertically-extending steel support columns such as shown by reference numerals 12, 14, and 16 extending from the floor 18 of the generator to a plurality of spaced horizontally-extending beams, one of which is shown by the reference numeral 20 which define the ceiling of the generator. A plurality of hangers 22 extend downwardly from the beam 20 for supporting a steam drum 24 having a downcomer 26 extending downwardly therefrom. A plurality of additional hangers 27 extend downwardly from the column 12 for supporting a heat recovery portion of the generator 10 which will be described in detail later. Three fluidized bed chambers A, B, and C are supported in the lower portion of the generator 10 by a bottom support system 28 of a conventional design. A continuous air distribution plate 30 extends horizontally through the entire width of all three chambers A, B, and C. Air plenums 34, 36, and 38 extend immediately below the chambers A, B, and C, respectively, for introducing air upwardly through the corresponding portions of the air distribution plate 30 into the chambers.

The chamber A is defined by the air distribution plate 30, a pair of vertically-extending spaced walls 40 and 42 and a diagonally-extending upper wall 44 while the chamber B is defined by the air distribution plate 30, the walls 42 and 44, and a vertically-extending wall 46 disposed in a spaced relation to the wall 42. It is understood that a pair of spaced sidewalls (not shown) are provided which cooperate with the walls 40, 42, 44, and 46 to form an enclosure and that these sidewalls, along with the walls 40, 42, 44, and 46 are formed by a plurality of waterwall tubes connected in an air tight relationship.

A bundle of heat exchange tubes 48 are provided in the chamber A for circulating fluid through the chamber as will be described in detail later. Similarly, a bundle of heat exchange tubes 50 are disposed in the chamber B for circulating fluid through the chamber as also will be described in detail later.

The wall 46 extends for substantially the entire height of the generator 10 and, along with a upright wall 51 disposed in a spaced relation thereto, defines the chamber C. An opening 52 is provided through each of the walls 42 and 46 in order to permit the flue gases from the chamber A to flow to the chamber B where they mix with those from the chamber B before the mixture passes to the chamber C. In chamber C the flue gases from the chambers A & B mix with those in the chamber C and pass upwardly in the latter chamber for passing through an opening 53 provided in the wall 51 and into a cyclone separator 54 disposed adjacent the chamber C. The separator 54 includes a funnel portion 56 which, in turn, is connected to a seal pot 58 having a discharge conduit 60 extending into the lower portion of the chamber C for reasons to be described later.

A heat recovery area, shown in general by the reference numeral 64, is disposed adjacent the upper portion of the chamber C on the side thereof opposite that of the cyclone separator 54. The heat recovery area 64 is defined by a vertical wall 66 extending in a spaced relationship to the wall **46*a* and a substantially horizontal wall 68 which spans the heat recovery area, the chamber C, and the cyclone separator 54**.

A wall 69 extends across the top of the cyclone separator 54 and the top of the chamber C and, together with the wall 68, defines a duct for passing gases from the cyclone separator 54 to the heat recovery area, as will be described later. The walls 66, 68, and 69 are also formed by a plurality of waterwall tubes connected in an air tight manner. A gas control damper system 70 is disposed in the lower portion of the heat recovery area 64 and controls the flow of gas through the heat recovery area in a manner to be described, before the gas passes over a tube bundle 72 and exits from a flue gas duct 74 to an air heater in a manner also to be described in detail later.

Figure 2:
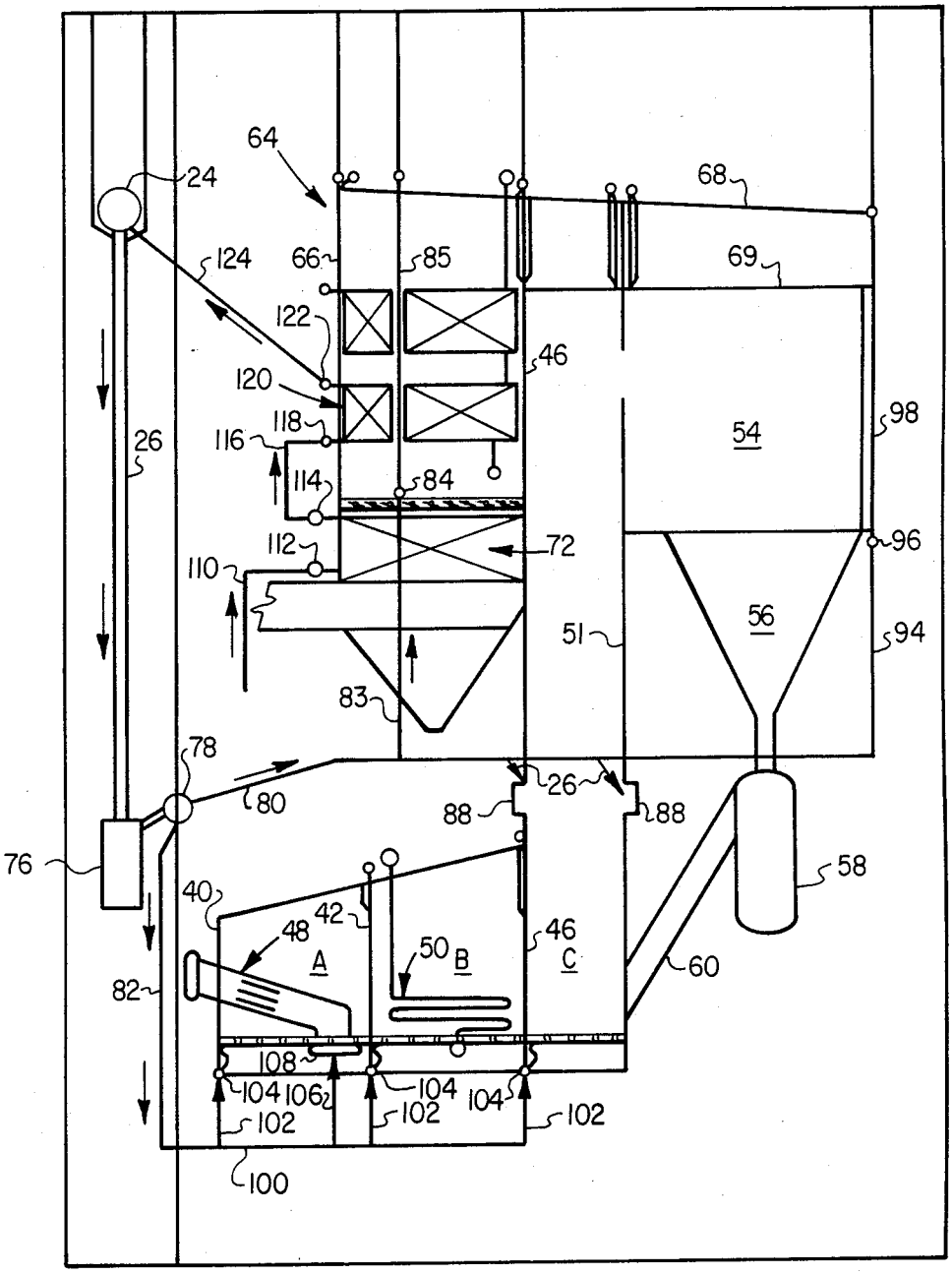
FIG. 2 is a view similar to FIG. 1 and depicting, in particular, the water flow circuit of the steam generator of the present invention.

FIG. 2 is a view similar to FIG. 1 but with some of the components of FIG. 1 deleted and additional components added in FIG. 2 for the convenience of presentation. FIG. 2 highlights the water flow circuit of the steam generator of FIG. 1 and, for this purpose, a pump 76 is connected to the lower portion of the downcomer 26 of the steam drum 24. Since more than one downcomer 26 and pump 76 can be provided, a manifold 78 is connected to the outlet of the pump(s) 76 for supplying water from the steam drum 24 to a plurality of substantially horizontally and vertically extending water lines, one of each of which are shown by the reference numerals 80 and 82.

A plurality of vertical feeders 83, one of which is shown in the drawing, extend from the water lines 80 and is connected to a header 84 which supplies water to a water tube wall 85 disposed in the heat recovery area 64, it being understood that other vertical feeders are connected to the water lines 80 for supplying water to the sidewalls (not shown) of the heat recovery area 64. A plurality of feeders 86 extend from the water lines 80 and are connected to headers (not shown) forming portions of a pair of seal assemblies 88 associated with each wall **46*a* and 51. The seal assemblies 88 function to accommodate relative differential expansion between the lower portion of the steam generator 10 supported by the support system 28 and the upper portion of the steam generator top-supported by the hangers 22 and 27. Since the seal assemblies 88 are fully disclosed in co-pending U.S. patent application Ser. No. 710,653, filed on Mar. 11, 1985, U.S. Pat. No. 4,604,972, and assigned to the same assignee as the present invention, they will not be described in any further detail. It is understood that the headers associated with the seal assemblies 88 supply water to the waterwall tubes forming the upper portions of the walls 46 and 51**.

An additional feeder 94 extends from each of the water lines 80 and supplies a header 96 for circulating water through a water tube wall 98 which, together with the walls 51 and 69, and the sidewalls (not shown), enclose the cyclone separator 54.

The vertical water lines 82 are respectively connected to horizontal water conduits 100 each of which has a plurality of vertically-extending feeders 102 extending therefrom which are connected to the headers 104 for supplying water to the walls 40, 42, and 46, respectively. Additional feeders 106 supply water from the water conduits 100 to corresponding headers 108 for the bundle of water tubes 48 in the chamber A.

A pipe 110 extends from a boiler feed pumping and preheating system (not shown) to an inlet header 112 for the tube bundle 72. The outlet of the tube bundle 72 is connected, via a header 114, a transfer line 116, and an inlet header 118 to a bundle of water tubes 120 disposed within the heat recovery area 64 and functioning as a economizer. The outlet of the tube bundle 120 is connected, via a header 122 and a transfer line conduit 124, to the inlet of the steam drum 24.

It follows from the foregoing that water flow through the circuit of the present invention is established from the boiler feed pump into and through the tube bundle 72, the tube bundle 120, and into the steam drum 24. Water is mixed with the steam supplied to the drum 24 and the resulting water passes through the downcomer 26 and, via the pump(s) 76, into the manifold 78. The water then passes from the manifold 78 through the water lines 80, the feeders 83 and 94, and to the waterwalls 66, 85, 46, 56, and 98. The water lines 82 supply water, via the conduits 100 and the feeders 104 and 106 to the walls 40, 42, and 46, and to the tube bundle 48.

Figure 3:
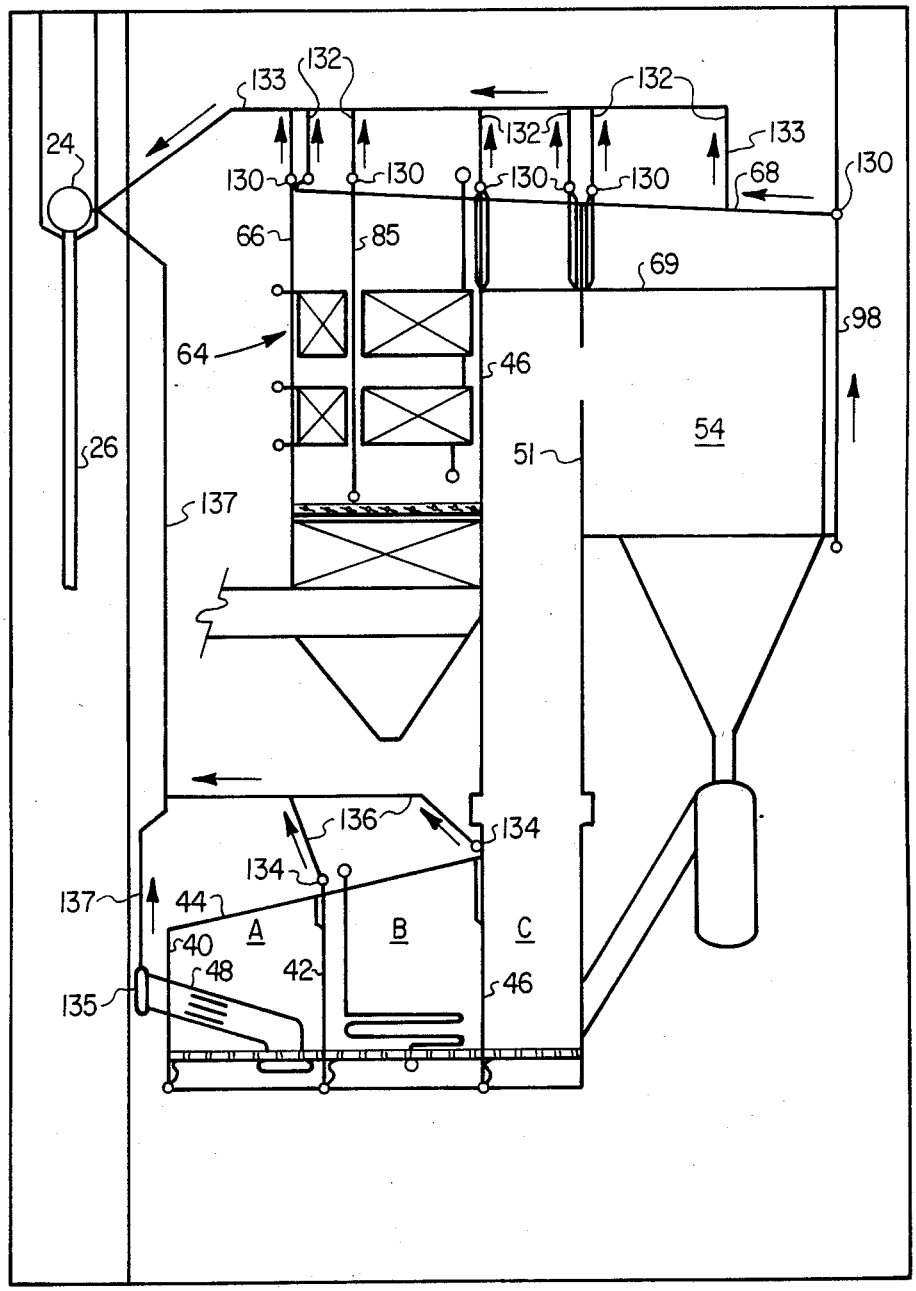
FIG. 3 is a view similar to FIG. 2 and depicting, in particular, the steam flow circuit of the steam generator of the present invention.

FIG. 3 is a schematic view similar to FIGS. 1 and 2, but with portions of the latter figures deleted and additional components added to better depict the steam riser flow circuit according to the present invention. The reference numeral 130 refers to a plurality of headers disposed at the upper end portions of the walls 66, 85, 46*a*, 51, and 98, it being understood that the side walls associated with the heat recovery area 64, the chamber C and the cyclone separator 54 would have similar type headers. A plurality of risers 132 extend upwardly from the headers 130 and connect with a conduit 133 which extends from the wall 68 to the steam drum 24 to transfer the fluid from the various headers in the wall into the steam drum.

The water passing through the walls 40, 42, 44, and 46 is converted to steam and passed to a pair of headers 134 while the water passing through the tube bundle 48 is also converted to steam and passed to a plurality of outlet headers, one of which is shown by the reference numeral 135. The steam from the headers 134 and 135 passes into the steam drum 24 via conduits 136 and 137 and mixes with the steam entering the steam drum from the conduit 133 in the manner described above.

Figure 4:
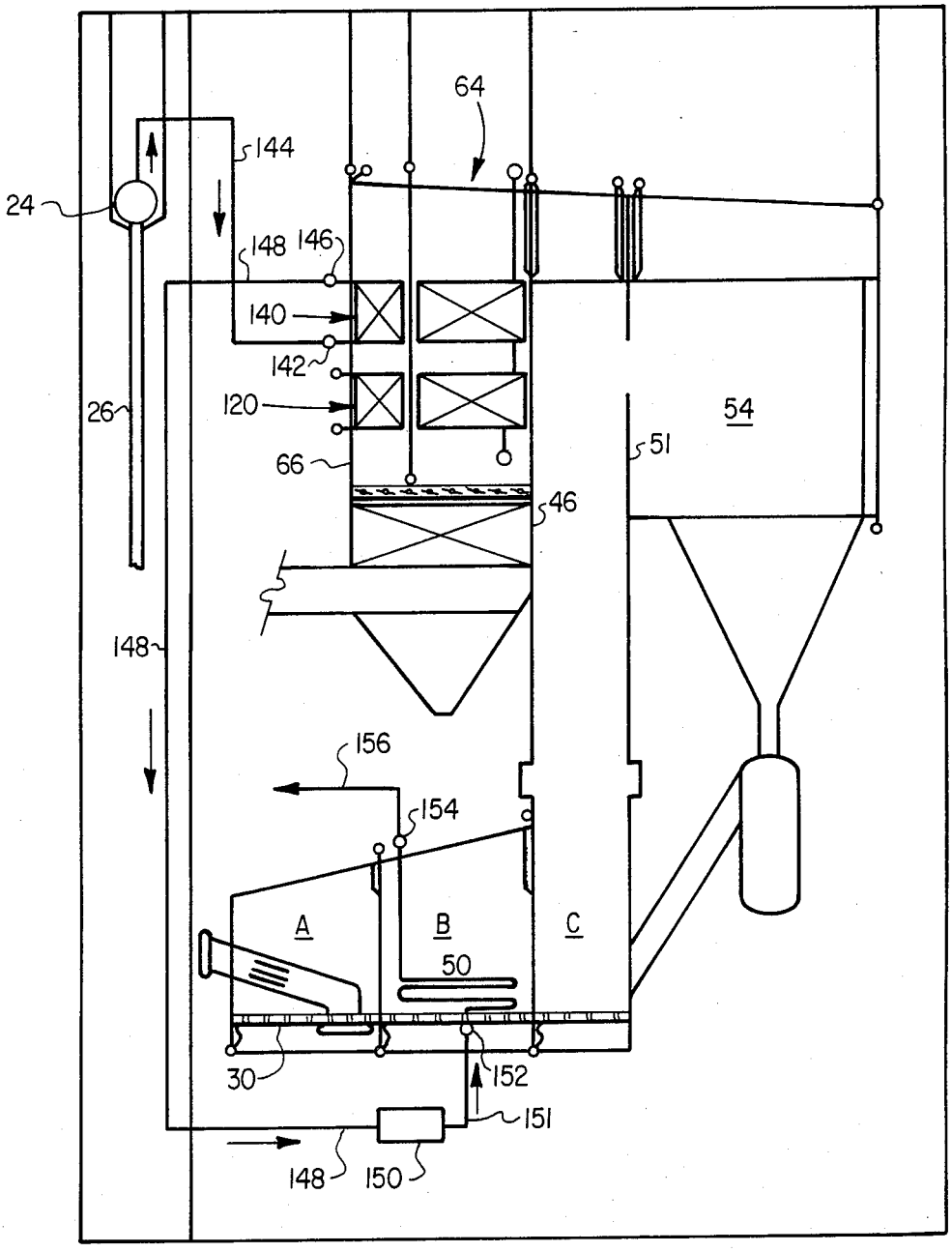
FIG. 4 is a view similar to FIG. 2 and depicting, in particular, the superheat circuit of the steam generator of the present invention.

FIG. 4 better depicts the superheat circuitry of the steam generator of the present invention, which includes a bundle of tubes 140 functioning as a primary superheater disposed in the heat recovery area 64 and having an inlet header 142 connected, via a conduit 144, to the outlet of the steam drum 24. After passing through the tube bundle 140 the superheated steam exits, via a header 146 and a conduit 148, to a spray attemperator 150. The temperature of the steam is reduced, as necessary, at the spray attemperator before it is introduced, via a conduit 151, into an inlet header 152 connected to the tube bundle 50 in the chamber B so that the tube bundle functions as a finishing superheater. The outlet of the tube bundle 50 is connected, via a header 154 and a conduit 156, to the inlet of the turbine (not shown). Thus the finishing superheater circuit established by the tube bundle 50 is independent of the steam generating circuit described in connection with FIG. 3.

Figure 5:
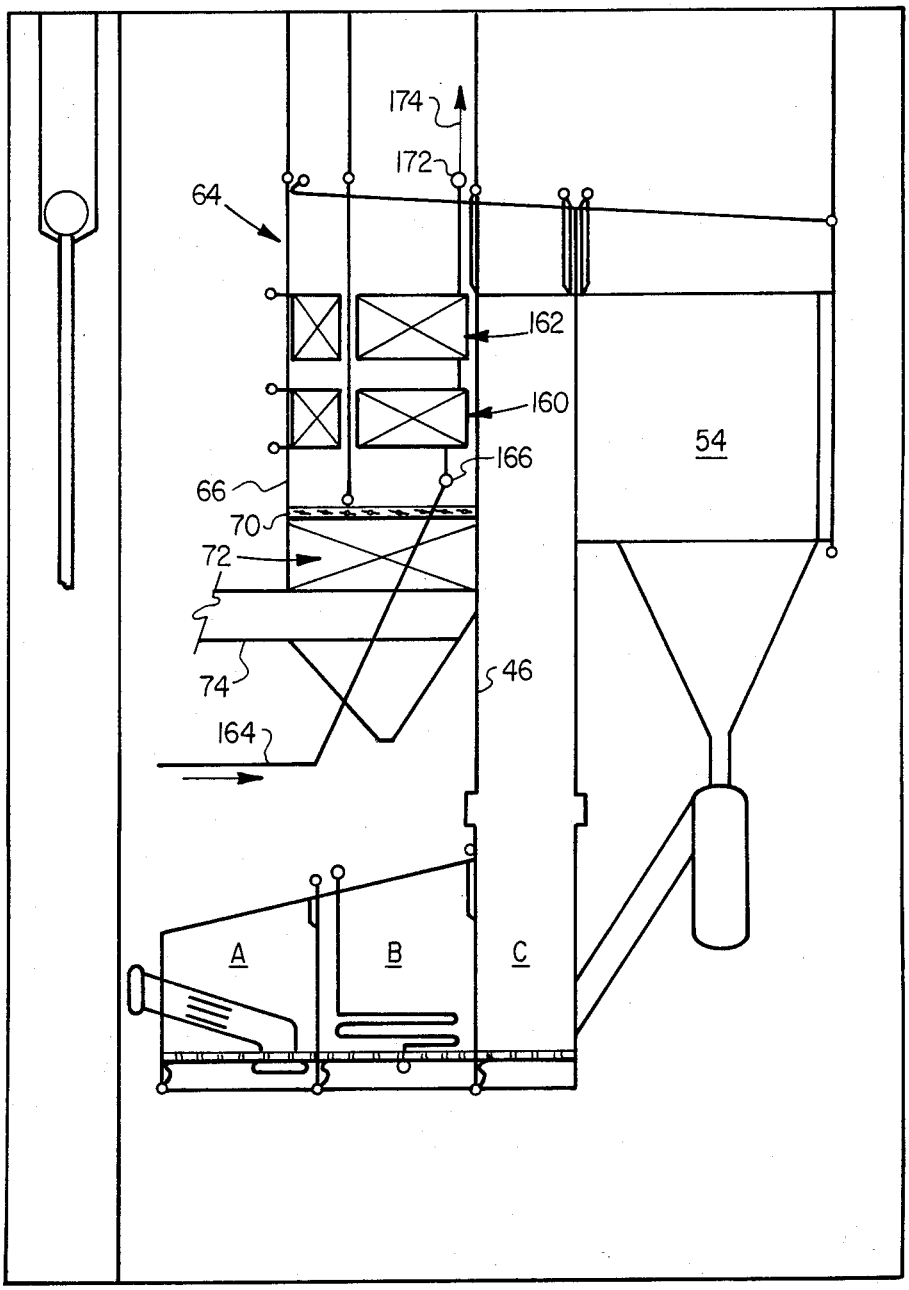
FIG. 5 is a view similar to FIG. 2 and depicting, in particular, the reheat circuit of the steam generator of the present invention.

The reheat circuit of the steam generator of the present invention is better disclosed in connection with FIG. 5 in which several components of the previous figures have been removed and a component added to FIG. 5, for the convenience of presentation. A plurality of tubes forming bundles 160 and 162 are provided in the heat recovery area 64 and each bundle functions as a reheater. One or two conduits, one of which is shown by the reference numeral 164, extend from the high pressure turbine (not shown) and is connected to an inlet header 166 which is connected to the tubes forming the tube bundles 160 and 162. After passing through the tube bundles 160 and 162 the reheated steam is passed to an outlet header 172 which, in turn, is connected, via one or two conduits 174, to a low pressure turbine (not shown). It is noted that this reheat flow circuitry is entirely independent from the steam generating flow circuitry shown in FIG. 3 and the superheat circuitry shown in FIG. 4.

Figure 6:
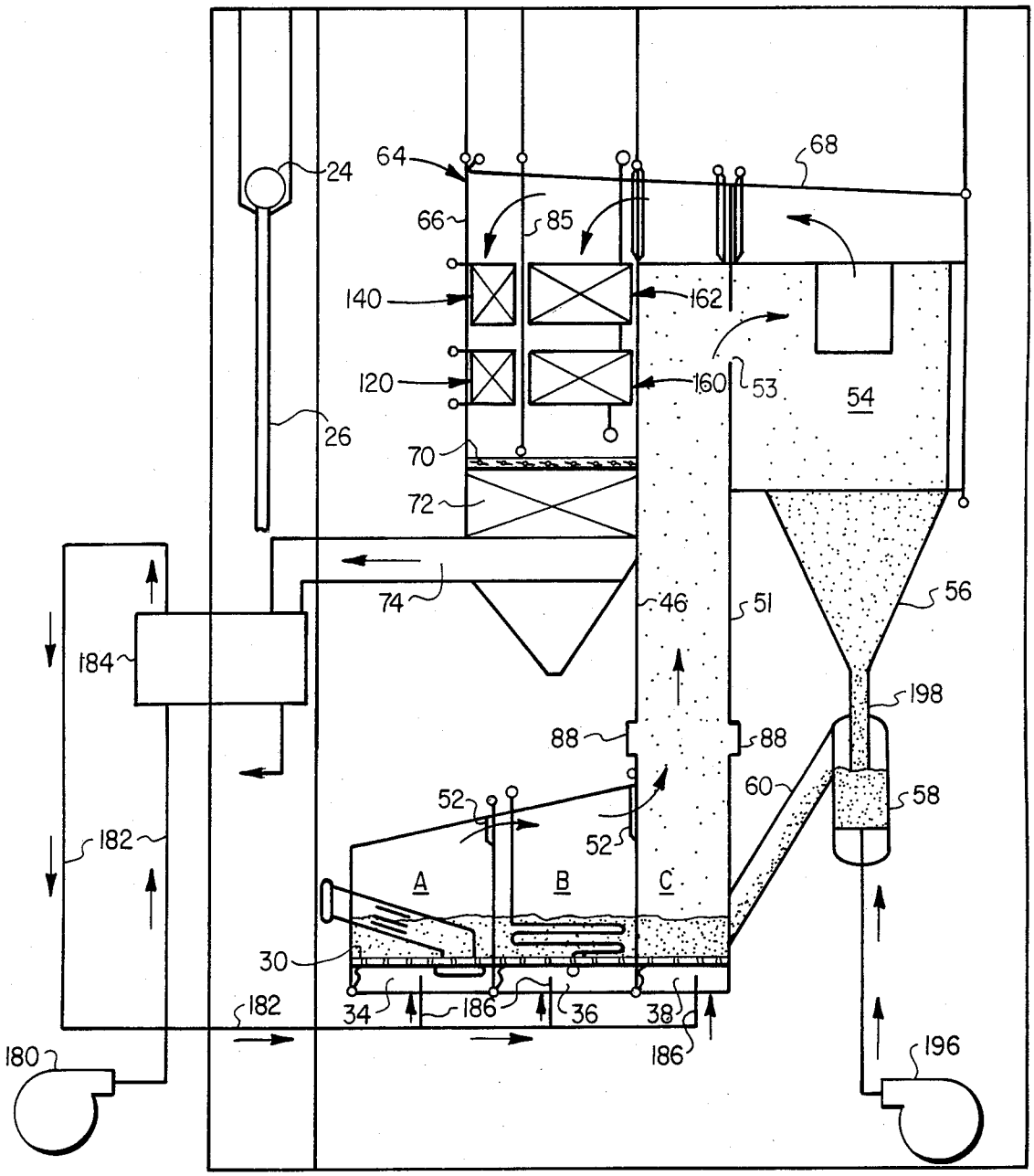
FIG. 6 is a view similar to FIG. 2 and depicting, in particular, the air and gas flow circuit of the steam generator of the present invention.

The air and gas circuitry of the steam generator 10 is better shown in connection with FIG. 6 with additional components being added and some of the components of the previous figures being deleted, for the convenience of presentation. More particularly, air from one or more forced draft fans 180 is passed, via a plurality of ducts, such as shown by the reference numeral 182, through an air heater 184 before it is introduced, via a plurality of vertical ducts 186 to the plenums 34, 36, and 38 extending below the chambers A, B, and C, respectively. A bed of particulate material is disposed in each of the chambers A, B, and C which is fluidized in response to the air passing upwardly from the plenums 34, 36, and 38, respectively, through the air distribution plate 30 and into the latter chambers. It is understood that each chamber A, B, and C may be subdivided by partitions, or the like (not shown), into segments that are used during start-up and for load control of the steam generator 10. The fluidizing velocity of the air introduced into the beds in the chambers A and B is regulated in accordance with the size of the particles in the bed so that the particulate material in the chambers A and B is fluidized in a manner to create a "bubbling" bed with a minimum of particles being entrained by the air and gases passing through the bed. The velocity of the air introduced into the chamber C relative to the particle size in the bed is such that a highly recirculating bed is formed, i.e. a bed in which the particulate material in the bed is fluidized to an extent that it is very near saturation for the entire length of the chamber C.

The fuel introduced to the beds in the chambers A and B is ignited and additional fuel and adsorbent is added to the beds by conventional feeders (not shown). The resulting flue gases, which includes the gaseous products of combustion and the air passing through the beds entrains a small portion of the relatively fine particulate material in the latter chambers. The resulting mixture of flue gases and particulate material in the chamber A passes through the opening 52 in the wall 42 and into the chamber B where it combines with a similar mixture in the latter chamber, before the resulting mixture passes through the opening 52 in the wall 46 and into the chamber C. As indicated above the velocity of the air passing, via the plenum 38, into the chamber C is such relative the size of the particles in the latter chamber such that the particles are suspended in the air and eventually transported upwardly through the length of the chamber C where they exit through the opening 53 formed in the upper portion of the wall 51 before passing into the cyclone separator 54. It is noted that, by virtue of the fact that chamber B is located between the chambers A and C, the fluidized bed in the chamber C may be thermally isolated from the fluidized bed in the chamber A. Alternatively, the fluidized bed material may be allowed to flow freely between the chambers A, B, and C through interconnecting grid plates (not shown).

The particulate material is separated from the gases in the cyclone separator 54 and the gases pass upwardly into the conduit defined between the walls 68 and 69, through openings formed in the walls 51 and 46 and into the heat recovery area 64. A portion of the gases in the heat recovery area 64 passes through the wall 85 which has openings formed therein for this purpose, before the gases pass over the tube bundles 120 and 140 forming the primary superheater and the economizer, respectively. The remaining gases pass over the tube bundles 160 and 162 forming the reheaters. The gases passing through the heat recovery area 64 in the foregoing manner then pass through the damper system 70, which can be adjusted as necessary to control this flow as well as the gas flow across the tube bundle 140 forming the primary superheater and the tube bundle 120 forming the economizer. The gases then pass across the tube bundle 72, through the outlet conduit 74, and into the air heater 184 where they give up heat to the air from the forced draft fan 180 before exiting to a dust collector, induced draft fan, and/or stack (not shown).

The solid particulate material separated in the cyclone separator 54 falls into the funnel portion 56 of the separator before discharging into the seal pot 58. The function of the seal pot 58 is to transport the material collected in the cyclone separator 54, which operates under a negative pressure, to the chamber C, which operates at atmospheric pressure, without letting the gases bypass the chamber. The seal pot is constructed in a conventional manner and, as such, consists of a low velocity bubbling bed which is fluidized by a fan 196. A dip leg 198 from the funnel portion 56 of the separator 54 discharges the material into the seal pot and, as more material comes into the seal pot, the level of the bed increases and overflows into the discharge conduit 60 where it flows into the chamber C. Thus the separated particulate material passed into the chamber C in a heated state, i.e. without being passed over any heat exchangers, or the like. Since the seal pot 58 operates in a conventional manner it will not be described in any further detail.

The method of the present invention provides several advantages. For example, the reheat circuitry depicted in FIG. 5 is entirely independent of the steam generating circuitry depicted in FIG. 3 and the superheat circuitry depicted in FIG. 4. Moreover, the use of the three separate fluidized beds enables the temperatures of the bed in the chamber A and the bed in the chamber B to be controlled independently of the temperature of the bed in chamber C by appropriate regulation of the air and fuel inputs to the respective beds. This is especially important since the temperature of the flue gases exiting the chamber C directly affects the reheat circuitry and thus enables the heat input and the temperature of the reheat steam to be regulated independently of the steam generation and the superheat steam temperature.

It is understood that several variations may be made in the foregoing without departing from the scope of the invention. For example, the main steam circuitry and the superheat circuitry can be associated with a single bed, and the beds in the chambers A, B, and C can be of the bubbling type or the circulating type.

Other modifications, changes, and substitutions are intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed:

1. A method of operating a steam generator comprising the steps of forming a first bed of particulate material in a vessel, forming at least one additional bed of particulate material in said vessel, introducing air and fuel into each of said beds to fluidize said beds and promote the combustion of said fuel, establishing a first flow circuit for passing water in a heat exchange relation to said additional bed for converting said water to steam, combining a mixture of flue gases and the entrained particulate material from said additional bed with that of said first bed, separating said entrained particle materials from the flue gases of said combined mixture, passing said separated particles back into said first bed, passing said steam to external equipment for using said steam, establishing a second flow circuit independent of said first flow circuit for receiving said steam from said equipment, and passing said separated flue gases in a heat exchange relation with said second flow circuit for reheating said steam.

2. The method of claim 1 further comprising the step of passing said steam from said first flow circuit to a steam drum, establishing a third flow circuit for receiving steam from said steam drum, and passing said separated flue gases in a heat exchange relation with said third flow circuit for superheating said steam.

3. The method of claim 2 wherein there are two additional beds and wherein said first flow circuit passes water in a heat exchange relation to one of said additional beds, and further comprising the step of establishing a fourth flow circuit for passing said superheated steam in a heat exchange relation to said other additional bed for further superheating said steam.

4. The method of claim 1 further comprising the step of controlling the velocity of air introduced to said first and additional beds relative to the size of the particulate material in said beds so that the said first bed operates as a circulating bed and said additional bed operates as a bubbling bed.

5. The method of claim 3 further comprising the step of controlling the velocity of air introduced to said first and additional beds relative to the size of the particulate material in said beds so that said first bed operates as a circulating bed and each of said additional beds operates as a bubbling bed.

6. The method of claim 1 wherein said first flow circuit includes water tubes forming walls defining said additional fluidized bed, and heat exchange tubes disposed in at least a portion of said additional bed.

7. The method of claim 1 wherein said second flow circuit includes a bundle of heat exchange tubes formed above said fluidized beds.

8. The method of claim 3 wherein said first and fourth flow circuits include water tubes forming walls defining said additional fluidized bed, and heat exchange tubes disposed in at least a portion of said additional bed.

9. The method of claim 2 wherein said second and third flow circuits include a bundle of heat exchange tubes formed above said fluidized beds.

10. The method of claim 1 wherein said separated particles are directly passed into said first bed without passing over any heat exchange surfaces.

11. The method of claim 1 further comprising the step of regulating the operating temperature of said first bed independently of the operating temperature of said additional bed.

12. A steam generator comprising a vessel, means of forming a first bed of particulate material in said vessel, means of forming at least one additional bed of particulate material in said vessel, means for introducing air and fuel into each of said beds to fluidize said beds and promote the combustion of said fuel, first flow circuit means for passing water in a heat exchange relation to said additional bed for converting said water to steam, means for directing a mixture of flue gases and the entrained particulate material from said additional bed into said first bed where it combines with a mixture of flue gases and entrained particulate material from said first bed, means for separating said entrained particle materials from the flue gases of said combined mixture, means for passing said separated particles back into said first bed, means for passing said steam to external equipment for using said steam, second flow circuit means independent of said first flow circuit means for receiving said steam from said equipment, and means for passing said separated flue gases in a heat exchange relation with said second flow circuit means for reheating said steam.

13. The steam generator of claim 12 further comprising means for passing said steam from said first flow circuit means to a steam drum, third flow circuit means for receiving steam from said steam drum, and means for passing said separated flue gases in a heat exchange relation with said third flow circuit means for superheating said steam.

14. The steam generator of claim 12 wherein there are two additional beds and wherein said first flow circuit means passes water in a heat exchange relation to one of said additional beds, and further comprising fourth flow circuit means for passing said superheated steam in a heat exchange relation to said other additional bed for further superheating said steam.

15. The steam generator of claim 12 further comprising means for controlling the velocity of air introduced to said first and additional beds relative to the size of the particulate material in said beds so that said first bed operates as a circulating bed and said additional bed operates as a bubbling bed.

16. The steam generator of claim 14 further comprising the step of controlling the velocity of air introduced to said first and additional beds relative to the size of the particulate material in said beds so that the said first bed operates as a circulating bed and each of said additional beds operates as a bubbling bed.

17. The steam generator of claim 12 wherein said first flow circuit means comprises a plurality of water tubes forming walls defining said additional fluidized bed, a plurality of heat exchange tubes disposed in at least a portion of said additional bed, and means for circulating said water and steam through said tubes.

18. The steam generator of claim 12 wherein said second flow circuit means comprises a bundle of heat exchange tubes formed above said fluidized beds and means for circulating steam through said latter tubes.

19. The steam generator of claim 14 wherein said first and fourth flow circuit means include a plurality of water tubes forming walls defining said additional fluidized bed, a plurality of heat exchange tubes disposed in at least a portion of said additional bed, and means for circulating water through said tubes.

20. The steam generator of claim 13 wherein said second and third flow circuit means include a bundle of heat exchange tubes formed above said fluidized beds, and means for circulating steam through said tubes.

21. The steam generator of claim 12 wherein said separated particles are directly passed into said first bed without passing over any heat exchange surfaces.

22. The steam generator of claim 12 further comprising means for regulating the operating temperature of said first bed independently of the operating temperature of said additional bed.

* * * * *